US006130587A

United States Patent [19]

Jun et al.

[11] Patent Number: 6,130,587

[45] Date of Patent: Oct. 10, 2000

[54] MICROSTRIPLINE/STRIPLINE ISOLATOR/ CIRCULATOR HAVING A PROPELLER RESONATOR

[75] Inventors: Dong Suk Jun; Meyung Soo Kim; Bon Hee Koo; Chang Hwa Lee; Sang Seok Lee; Tae Goo Choy, all of Daejeon, Rep. of Korea

[73] Assignee: Electronics and Telecommunications Research Institute, Daejeon, Rep. of Korea

[21] Appl. No.: 09/131,415

[22] Filed: Aug. 10, 1998

[30] Foreign Application Priority Data

Sep. 12, 1997 [KR] Rep. of Korea ..... 97-47037

[51] Int. Cl.[7] ..... H01P 1/36

[52] U.S. Cl. ..... 333/24.2; 333/1.1

[58] Field of Search ..... 333/1.1, 24.2

[56] References Cited

U.S. PATENT DOCUMENTS

| | | | |
|---|---|---|---|
| 3,513,413 | 5/1970 | Nakahara et al. | 333/1.1 |
| 3,617,945 | 11/1971 | Nakahara et al. | 333/1.1 |
| 3,935,548 | 1/1976 | Rosenbaum et al. | 333/1.1 |
| 4,761,621 | 8/1988 | Kane et al. | 333/1.1 |

FOREIGN PATENT DOCUMENTS

| | | | |
|---|---|---|---|
| 0265001 | 4/1988 | European Pat. Off. . | |
| 2007032 | 5/1979 | United Kingdom | 388/1.1 |

OTHER PUBLICATIONS

Circulators Using Planar Triangular Resonators; Joseph Helszajn; David S. James and W. Terence Nisbet; 1979.

Circulators Using Planar WYE Resonators; Joseph Helszajn and W. Terence Nisbet; 1981; pp. 689–699.

Characteristics of Circulators Using Planar Triangular and Disk Resonators Symmetrically Loaded with Magnetic Ridges; Joseph Helszajn; Reinhard D. Baars and W. Terence Nisbet; 1980; pp. 616–621.

*Primary Examiner*—Paul Gensler

*Attorney, Agent, or Firm*—Antonelli, Terry, Stout & Kraus, LLP

[57] ABSTRACT

An isolator/circulator can keep a size of a 3-way asymmetric propeller resonator and intensity of magnetism, control the preferred frequency, and improve the insertion loss and isolation characteristic due to reducing the ferrite usage region on the maximum, extend the wide band without the external wide band extension, finally to miniaturize, reduce the fabricating cost by means of a simple fabrication. A microstrip/stripline isolator/circulator having a propeller resonator can be used for the device protection and impedance matching of a system and terminal in a transfer communication, personal communication, CT and satellite communication.

9 Claims, 8 Drawing Sheets

FIG. 1a(1)
PRIOR ART
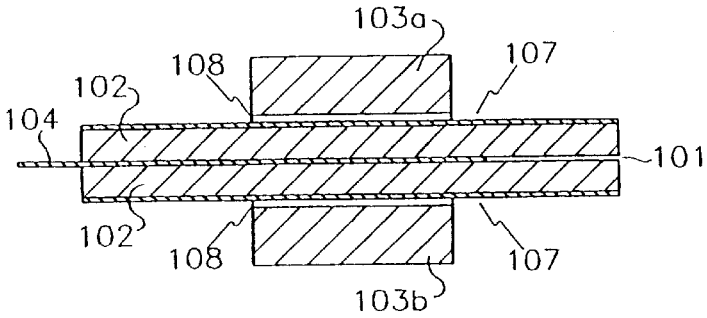
FIG. 1a(2)
PRIOR ART
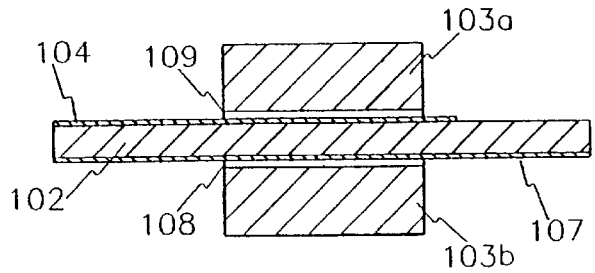
FIG. 1b
PRIOR ART
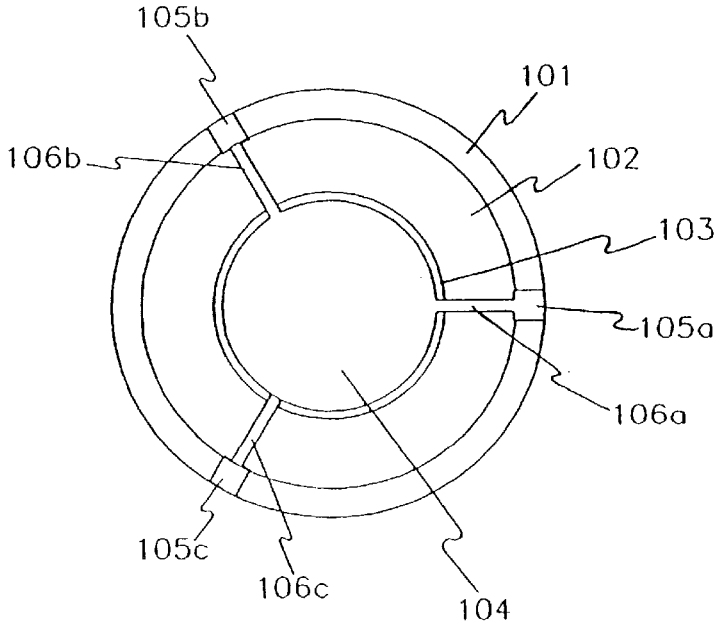

MICROSTRIPLINE/STRIPLINE ISOLATOR/ CIRCULATOR HAVING A PROPELLER RESONATOR

BACKGROUND OF THE INVENTION

1. Field of the Invention

The present invention relates to an isolator/circulator which can be used for the component's protection and impedance matching of a system and terminal in a transport communication system, a personal communication system, CT (Cordless Telephone) and satellite communication systems and, more particularly, to a microstripline/stripline isolator/circulator with a propeller-type resonator.

2. Description of the Prior Art

Recently, it has been required that a isolator/circulator to be reduced in size, weight and manufacturing costs due to the miniaturization of transport communication systems, satellite communication systems and millimeter wave. Desirable characteristics include a low insertion loss, a high isolation and a wide bandwidth.

Generally, an "isolator" passing a propagation in the forward direction without attenuation is a device for absorbing a propagation in the reverse direction, a "circulator" is a circuit device circulatory arranged between terminals for input and output thereof. Such an isolator/circulator device is a directional device, a high value-added device which is used in a transport communication system, a satellite communication system and a millimeter wave because the frequency modulation control is easy.

The conventional art for such an isolator/circulator will be explained by means of the attached drawings as follows.

FIG. 1(*a*)(1) is a structural view of a conventional microstrip/stripline isolator/circulator.

FIG. 1(*a*)(2) is a sectional view of a conventional microstrip/stripline isolator/circulator, and FIG. 1*b* is a plane view of FIG. 1*a*.

As shown FIGS. 1(*a*)(1) and 1(*a*)(2), a conventional 3-terminal microstrip/stripline isolator/circulator includes a microstrip/stripline pattern 104 on the upper portion of a ferrite substrate 102 and on the lower portion of the ferrite substrate 102, an upper permanent magnet 103*a* over the upper portion of the ferrite substrate 102 and a lower permanent magnet 103*b* under the lower portion of the ferrite substrate 102, and a thin iron plate 108 between the upper permanent magnet 103*a* and a microstrip/stripline 104. In the case of microstrip 104, a thin dielectric is inserted between microstrip 104 and the thin iron plate 108.

As shown in FIG. 1*b*, an electrode pattern of the microstrip/stripline 104 comprises a circular resonator 104 resonating on a constant frequency in the central portion, a first electrode 105*a* and a second electrode 105*b* and a third electrode 105*c* being achieved symmetrically to each other in the circumference of the circular resonator 104 and 3 electrode terminals which connect an external circuit with the circular resonator 104 through the respective transfer tracks 106*a*, 106*b*, 106, and a 50Ω load resistence being connected to the third electrode 105*c* in the case of an isolator.

In such a microstrip/stripline isolator/circulator, a signal of the external circuit is transferred from the first electrode 105*a* composed of a first port to the second electrode 105*b* composed of a second port, similarly from the second electrode 105*b* to the third electrode 105*c*, and from the third electrode 105*c* to the first electrode 105*a* in a clockwise direction by means of non-reversible characteristic of the microstrip/stripline 104 formation on the ferrite substrate 102, the upper permanent magnet 103*a* and lower permanent magnet 103*b*. In the case of an isolator, the signal is transferred from the second electrode 105*b* to the third electrode 105*c*, and the signal is extinguished through the load resistance. That is, since the signal is transferred from the first electrode 105*a* to the second electrode 105*b*, and not from the second electrode 105*b* to the first electrode 105*a*, it performs the action of an isolator. Then, the signal transfer direction can be set in the counterclockwise direction.

However, in a conventional microstrip/stripline isolator/circulator using such a circular resonator 104, the size of the circular resonator 104 is inversely proportional to a resonator frequency, however, there is a problem that it is difficult to fabricate a miniature isolator/circulator due to limitations in reducing the size of the circular resonator 104 to be used for UHF for a transfer communication or personal communication.

Accordingly, there has been active pursuit of study for developing an isolator/circulator having a microstrip/stripline comprising a miniaturized isolator/circulator to be efficiently used for UHF for a transfer communication system or personal communication system according to the miniature trend and communicative system development. FIG. 2 illustrates a form of a typical conventional microstrip/stripline pattern related to this pursuit.

FIG. 2 illustrates another pattern form of a microstrip/stripline to a convention isolator/circulator.

As shown in FIG. 2, a microstrip/stripline of a conventional isolator/circulator is composed of a circular resonator 204 formed in the central portion as an electrode pattern, three slots 207 formed in the central direction from a circumference of the circular resonator 204 to control a magnet coupling quantity, a first electrode 205*a*, a second electrode 205*b* and a third electrode 205*c* constituting three symmetric ports which connect the resonator 204 with external circuit in the circumference thereof through the respective transfer tracks 206*a*, 206*b*, 206*c*, and a load resistence.

In a conventional microstrip/stripline isolator/circulator constructed as described above, since a magnet wall is formed in the slot 207 of the microstrip/stripline, the length of the slot 207 in the same frequency can be controlled compared to the microstrip/stripline shown in FIG. 1, and as a result, there can be performed a miniaturization of the isolator/circulator. However, the magnet wall formed on the resonator is used. The size of the magnet used is greater than that of the resonator. A circuit should be connected to the external in order to expand the bandwidth. Accordingly, if the bandwidth is expanded, the isolator/circulator size increases, thus prohibiting reduced size in fabrication thereof and increasing manufacture costs. In addition, there is a limit to reducing an insertion loss with regards to the characteristic thereof.

Since there is applied a magnet to the size of the resonator formed on the ferrite, ferromagnetic resonance line width (ΔH) of loss portion of magnetic material is related by the resonator size, therefore, to minimize the low insertion loss.

FIG. 3 shows another pattern form of a microstrip/stripline for a conventional isolator/circulator.

As shown in FIG. 3, a microstrip/stripline of a conventional isolator/circulator is composed of a triangular resonator 304 formed in the central portion as an electrode pattern, three slots 307 formed in the central direction from the respective side of the triangular resonator 304 to control a magnetic coupling quantity, open λ/4 ring type coupling transfer tracks 306*a*, 306*b* and 306*c*, on a ring type dielectric material 308 around the resonator 304, a first electrode 305*a*, a second electrode 305*b* and a third electrode 305*c* constituting symmetric ports to connect the external circuit with open λ/4 ring type coupling transfer tracks, and a load resistence. The open λ/4 ring type coupling transfer tracks 306*a*, 306*b*, 306*c*, of each terminal case magnetic coupling, the groove of the triangular resonator 304 cause the magnetic coupling. Due to these magnetic couplings, in order to perform a miniaturization of an isolator/circulator, since the respective terminal of open λ/4 ring type coupling transfer tracks and the respective terminals 305*a*, 305*b*, 305*c* cause the magnetic coupling, the triangular resonator portion of open λ/4 ring type coupling transfer tracks 306*a*, 306*b*, 306*c* and the triangular resonator 304 cause the magnetic coupling, impedance matching is preferable. In addition, it is preferable to simplify manufacturing. However, there is a limit for reducing the size because of using the magnetic coupling as in FIG. 2.

SUMMARY OF THE INVENTION

It is an object of the present invention to provide an isolator/circulator of a microstrip/stripline which can be miniaturized, a low insertion loss, high isolation and bandwidth, and a low fabricating price by simplifying a fabrication process. There are required miniaturization of the apparatus and simplification thereof, including reduction in weight, and reduction in price of an isolator/circulator used in a transfer communication system, satellite communication system and millimeter wave. Further, there are required a low insertion loss, high isolation and an expanded bandwidth. To overcome conventional art problems as described above, the present invention provides a low insertion loss and a high isolation and bandwidth, miniaturization, simplification, and reduced weight, and a low price of an isolator/circulator of a microstrip/stripline.

In order to accomplish the above object, the present invention provides a stripline isolator/circulator having a propeller resonator comprising a stripline isolator/circulator for a microwave composed of an upper ferrite substrate, a lower ferrite substrate, an upper grounded electrode having a hole formed therein, the hole whose four fixed screws are penetrated through and an upper permanent magnetic installed being positioned on the upper ferrite substrate, a lower grounded electrode having a groove formed therein, the groove having a fixed screw penetrated through the hole and a lower permanent magnet installed being positioned on the lower ferrite substrate, an upper cover and lower cover for protecting the magnetism, SMA connectors for connecting the stripline with the external circuit, and a load resistence, in which a stripline positioned between said upper ferrite substrate and lower ferrite substrate comprises: three magnetic wall coupling controlling slots having a resonator formed in the form of asymmetric propeller to control a magnetic coupling of the verge of said resonator for easily controlling the frequency; a 3-way asymmetric propeller resonator for transmitting a signal in a single direction in which said magnetic wall coupling controlling slots provided; three bandwidth controlling transmission lines for controlling the bandwidth by use of a ratio of length of the transmission line, formed in one side of the respective magnetic wall coupling controlling slots as one body; and three terminal electrodes for connecting said each bandwidth controlling transmission lines with an external circuit to transmit the signal as one body.

In another aspect of the present invention, the present invention comprises a microstripline isolator/circulator having a propeller resonator comprising a microstripline isolator/circulator for a microwave composed of a ferrite substrate, a thin Teflon dielectric, an upper grounded electrode having a hole formed therein, the hole having four fixed screws penetrated therethrough and an upper permanent magnet being positioned on the teflon dielectric, a lower grounded electrode having a groove formed therein, the groove having a fixed screw penetrated through the hole and a lower permanent magnet being positioned on the lower ferrite substrate, an upper cover and lower cover for protecting the magnetism thereof, SMA connectors for connecting the stripline with the external circuit, and a load resistance, in which a microstripline positioned between said ferrite substrate and thin Teflon dielectric comprises: first through third magnetic wall coupling controlling slots having a resonator formed in the shape of an asymmetric propeller to control a magnetic coupling on the verge of said resonator for easily controlling the frequency;

a 3-way asymmetric propeller resonator having an excellent signal transmission characteristic in a single direction having said magnetic wall coupling controlling slots provided thereof;

a first through third bandwidth controlling transmission lines for controlling the bandwidth by use of a ratio of length of the transmission line, formed in one side of the respective magnetic wall coupling controlling slots as one body; and first through third terminal electrodes for connecting said each bandwidth controlling transmission lines with an external circuit to transfer the signal as one body.

BRIEF DESCRIPTION OF THE DRAWINGS

The above and other objects and features of the present invention will become apparent from the following description of preferred embodiments, when taken in conjunction with the accompanying drawings, in which:

FIG. 1(*a*)(1) is a structural view of a conventional microstrip/stripline isolator/circulator.

FIG. 1(*a*)(2) is a sectional view of a schematic isolator/circulator of a conventional general microstrip/stripline.

FIG. 1*b* is an electronic pattern and plane view of a microstrip/stripline according to FIGS. 1(*a*)(1) and 1(*a*)(2).

DETAILED DESCRIPTION OF THE PREFERRED EMBODIMENTS

Hereinafter, the preferable embodiment of the present invention will be explained in detail by means of the drawings.

FIGS. 4*a* through 4*c* and FIGS. 5*a* and 5*b* show a microstrip/stripline pattern for an isolator/circulator according to a preferable embodiment of the present invention.

Figure 2:
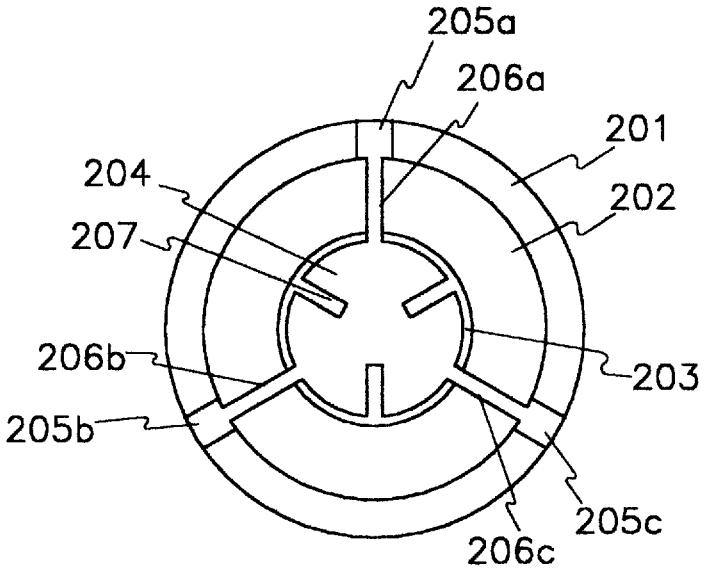
FIG. 2 PRIOR ART
FIG. 2 is another pattern view of a microstrip/stripline for a conventional isolator/circulator.
Figure 3:
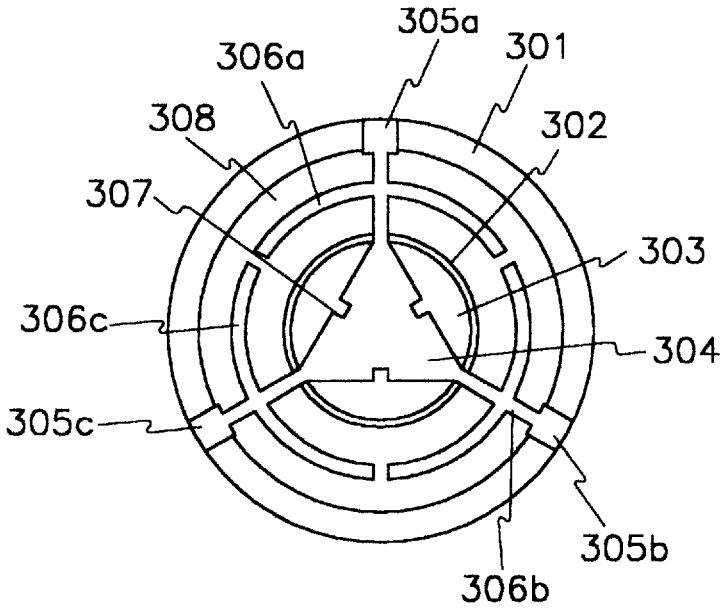
FIG. 3 PRIOR ART
FIG. 3 is another pattern view of a microstrip/stripline for a conventional isolator/circulator.
Figure 4A:
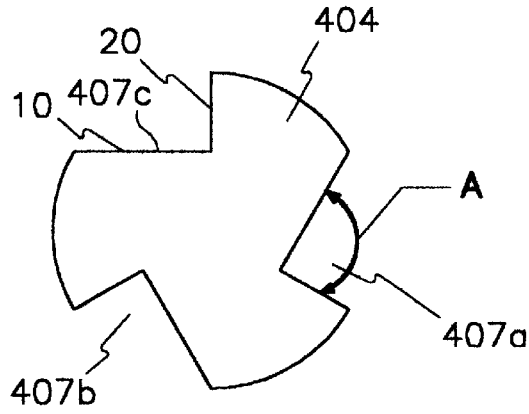
FIGS. 4*a*–4*c*, 5*a* and 5*b* are pattern views of an isolator/circulator having a propeller resonator according to a preferred embodiment of the present invention.
Figure 4B:
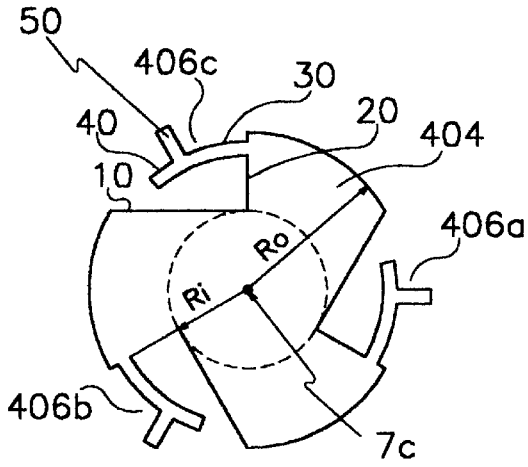
Figure 4C:
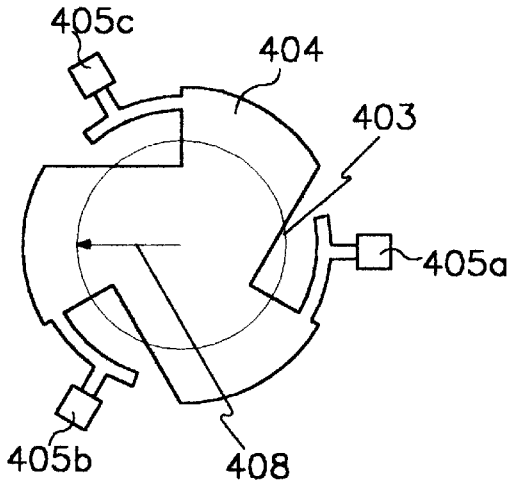
Figure 5A:
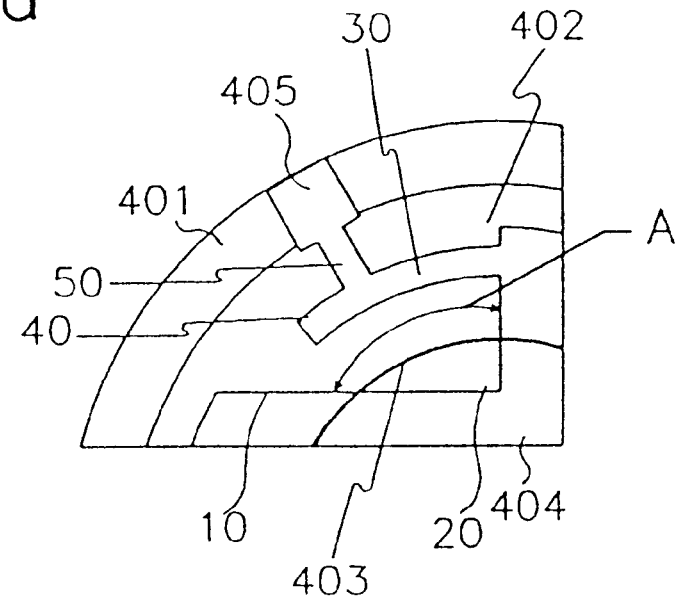
Figure 5B:
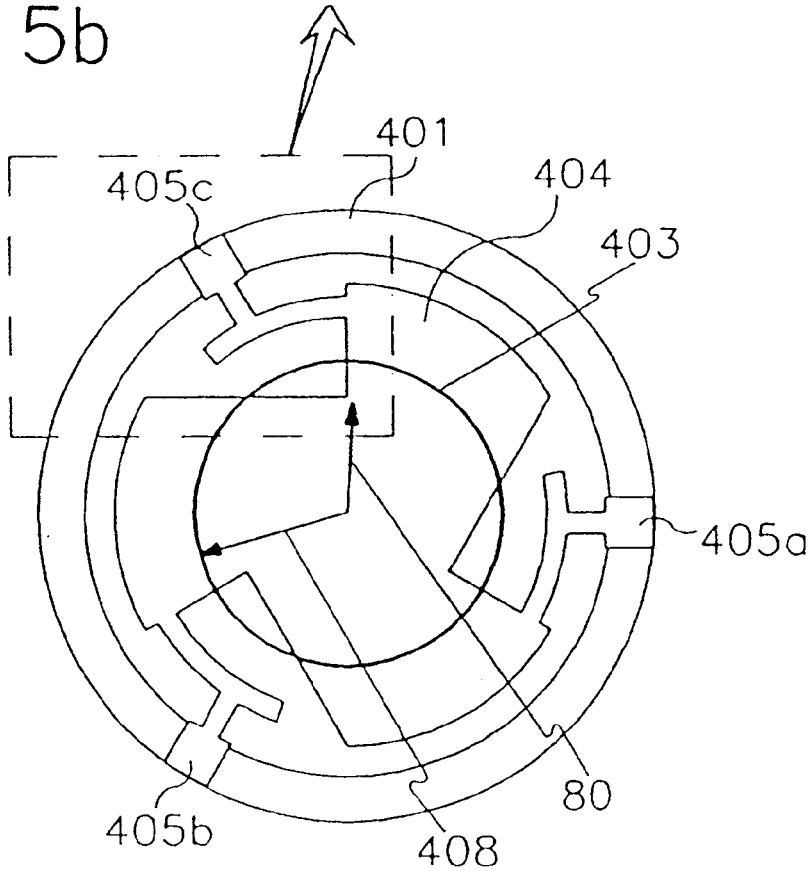

With reference to (a) through (c) of FIGS. 4 and FIGS. 5*a* and 5*b*, a microstrip/stripline pattern is composed of first through third magnetic wall coupling controlling slots 407*a*, 407*b*, 407*c* each having a resonator formed therein in the shape of an asymmetric propeller to control a magnetic coupling of the edge of the resonator 404 so that the frequency can be controlled easily, a 3-way asymmetric propeller resonator 404 having excellent signal transmission characteristics in the single direction in which the magnetic wall coupling controlling slots are provided, first through third bandwidth controlling transmission lines 406*a*, 406*b*, 406*c* for controlling the bandwidth by use of the longitudinal ratio of the transmission line, being formed to one side of the respective magnetic wall coupling controlling slots as one body, and first through third terminal electrodes 405*a*, 405*b*, 405*c* which connect the external circuit with the respective bandwidth controlling transmission line to transmit the signal, formed in the shape of one body. The stripline having such three way asymmetric propeller resonator corresponds to 505 as the drawing numeric in FIG. 6, the microstripline corresponds to 605 in FIG. 7.

The first through third magnetic wall coupling controlling slots 407*a*, 407*b*, 407*c* are respectively formed to have the same random angle "A" as the 3-way asymmetric propeller resonator 404 as shown in FIG. 4*a*. Although formed in rectangular form in FIG. 4*a*, the angle "A" can be controlled according to the bandwidth control and insertion loss. There is formed the 3-way asymmetric propeller resonator 404 according to the form of such magnetic wall coupling controlling slots 407*a*, 407*b*, 407*c*.

The first through third bandwidth controlling transmission lines 406*a*, 406*b*, 406*c* are respectively connected to one side surface 20 in the respective magnetic wall coupling controlling slots 407*a*, 407*b*, 407*c* as one body, a connective structure which is not connected to other side surface 10 in approaching to the circumference of the 3-way asymmetric propeller resonator 404.

Each of the first through third bandwidth controlling transmission lines 406*a*, 406*b*, 406*c* are composed of a first transmission line 30 extensibly connected to one side surface 20 of the slot, a second transmission line 40 extending and being connected to the first transmission line 30, and a third transmission line 50 positioned between the first and second transmission lines 30, 40 and being in the central direction of the resonator 404. The transmission lines 406*a*, 406*b*, 406*c* are connected to one side surface 20 of each slot of propeller resonator 401. The electrical length of the second transmission line 40 is vulnerable to the choice of manufacturing material but it is easy to flexibly control the electrical length of the second transmission line 40.

The isolator/circulator using a microstrip/stripline having the 3-way asymmetric propeller resonator of the present invention can be miniaturized since a basic mode of the 3-way asymmetric propeller resonator 404 performing a single directional signal transmission geometrically is low.

When the respective magnetic wall coupling controlling slots 407*a*, 407*b*, 407*c* are formed in any angle "A", it is possible that the frequency control in the ratio of a half-diameter Ri of the resonator be inscribed to a radius Ro of the circumscribed resonator. This relation is that the frequency is high when the ratio thereof is low.

That is, there can be miniaturized a microstrip/stripline isolator/circulator using this ratio.

The transmission lines 406*a*, 406*b* and 406*c* which control frequencies and impedances, transmission lines 30, 40 and 50 having the length of $\lambda/4$ of the central frequency of the transmission lines 406*a*, 406*b* and 406*c*, as shown in FIG. 4*b*, can be bandwidth controlled using the ratio of the length of a first transmission line 30 and second transmission line 40. Since this effect extends the bandwidth, it can be reduced.

If the position of the third transmission line 50 reduces the first transmission line 30, the central frequency of the resonator is moved, the characteristic of a right symmetry does not happen. That is, if the length of the first transmission line 30 reduces, it is inclined to a low frequency, and there is suddenly formed a pole point (FIG. 10*b*) at the frequency lower than the resonator frequency. On the contrary, if the first transmission line 30 increases, the resonance occurs at a high frequency, and it is formed at the frequency whose pole point (FIG. 10*b*) is high. Using this effect, it is possible to prefer the attenuation characteristic of adjoining frequency as well as the attenuation characteristic of the resonance frequency (referring to FIGS. 10*a*–10*c*).

Furthermore, there can be reduced an uneven magnetic effect of a magnet because of the reduced size of the magnet 406 (corresponding to 508*a*, 508*b* in FIG. 6, corresponding to 608*a*, 608*b* in FIG. 7) having a low insertion loss controlling radius 408 in the characteristic of structure. There is used a miniature magnetic structure 403 (namely, the size thereof being smaller than the resonator 404) to have any form which embodies a low insertion loss characteristic due to reducing the usage region of ferrite. There should be no action taken for an even-sized magnet and a large magnet for forming the even-sized magnet. Further, there can be reduced any effect on the external circuit. Furthermore, it is preferable to transfer the signal because of reducing a ferromagnetic resonance resonance line width ($\Delta H$) effect of a loss of magnetic material occurred when using the magnetic material. That is, there can be fabricated an isolator/circulator having a low insertion loss characteristic due to reducing the usage region of ferrite.

Figure 6:
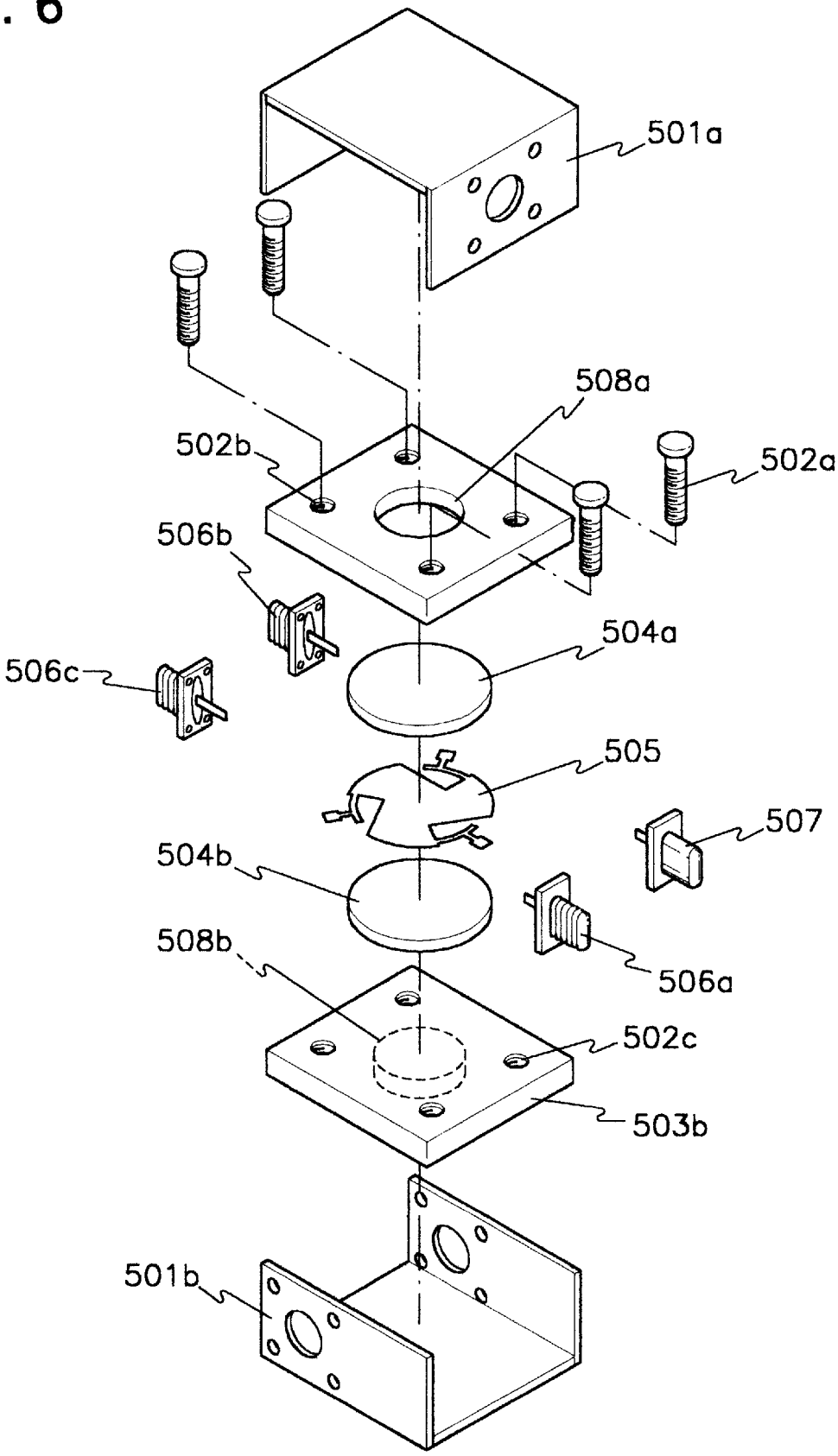
FIG. 6 is an exploded perspective view of a stripline isolator/circulator having a propeller resonator according to a preferable embodiment of the present invention.

FIG. 6 is an exploded perspective view of a stripline isolator/circulator having an asymmetric propeller resonator, using FIG. 4.

FIG. 6 includes an upper ferrite substrate 504*a*, positioned above on the basis of a stripline 505 having the 3-way asymmetric propeller resonator, a lower ferrite substrate 504*b* positioned below the stripline, an upper grounded electrode 503*a* whose a hole 502*b* is formed, the hole whose four fixed screw 502*a* are penetrated therethrough and an upper permanent magnet 508*a* is installed being positioned on the upper ferrite substrate 504*a*, a lower grounded electrode 503*b* having a groove 502*c* formed therein, the groove 502*c* having a fixed screw 502*a* penetrated through the hole 502*b* and a lower permanent magnetic 508*b* installed on the lower ferrite substrate 504*b*, an upper cover 501*a* and lower cover 501*b* for protecting the magnetism, SMA connectors 506*a*, 506*b*, 506*c* for connection with the external circuit, and a load resistance 507.

Figure 7:
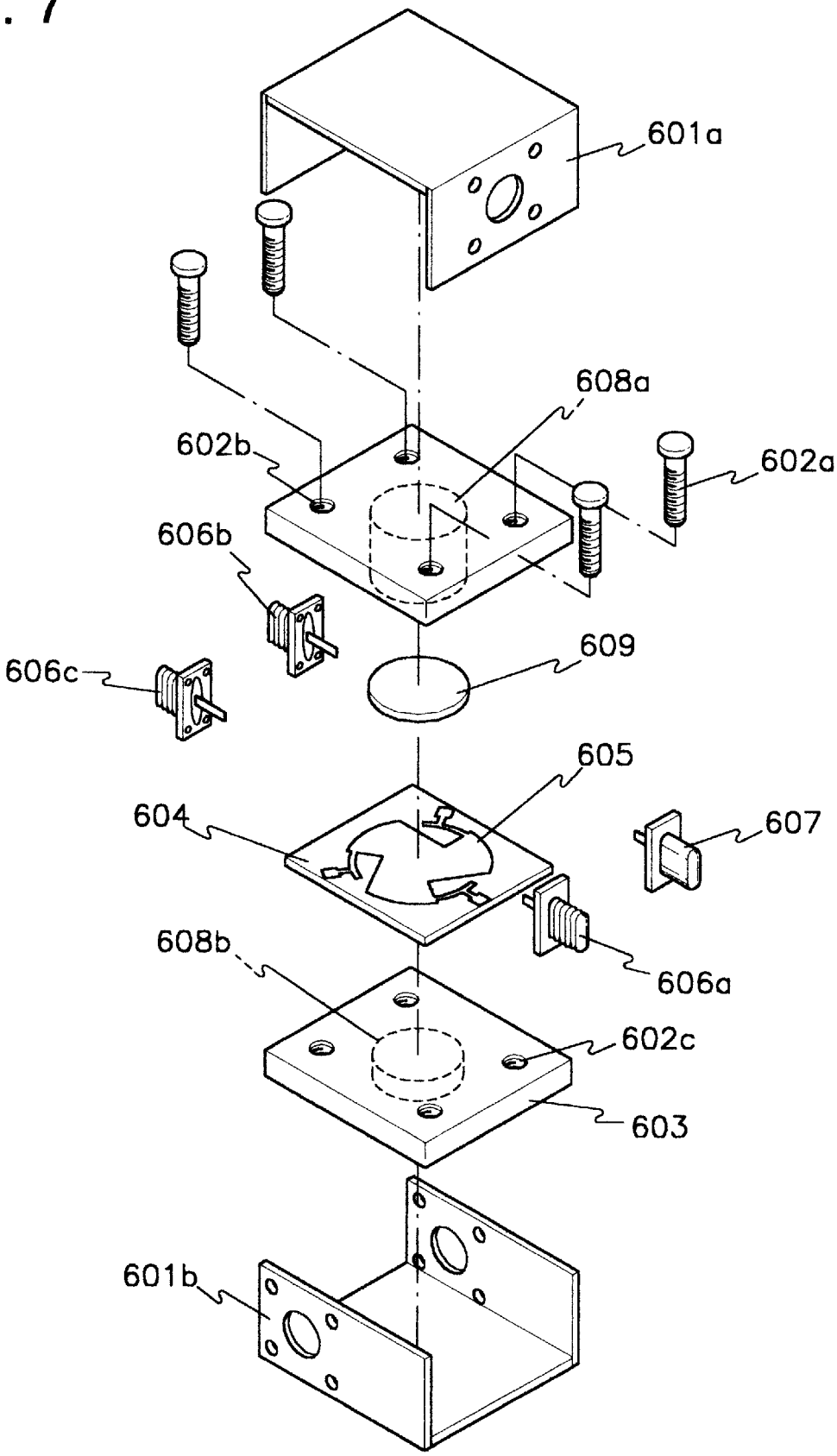
FIG. 7 is an exploded perspective view of a microstrip isolator/circulator having a propeller resonator according to a preferable embodiment of the present invention.

FIG. 7 is an exploded perspective view of a microstrip isolator/circulator having an asymmetric propeller resonator, using FIG. 4.

FIG. 7, a microstripline pattern 605 formed on the ferrite substrate 604, a thin Teflon dielectric 609 formed above on the microstripline pattern 605, an upper grounded electrode 610 having a hole 602*b* formed thereat, the hole having four fixed screws 602*a* being penetrated through and an upper permanent magnetic 608*a* which is longer than the length of the penetrating hole 602*b* on the central portion installed on the Teflon dielectric 609, a lower grounded electrode 603 having a groove 602*c* formed thereon, the fixed groove 602*c* having a fixed screw 602*a* being penetrated through the hole 602*b* and a lower permanent magnet 608*b* installed on the lower ferrite substrate 604, an upper cover 601*a* and lower cover 601*b* for protecting the magnetism, SMA connectors 606*a*, 606*b*, 606*c* for connection with the external circuit, and a load resistance 607.

As shown in FIGS. 6 and 7, it can be simplified by a simple fabrication process, miniaturized and reduced manufacture price by means of using the 3-way asymmetric propeller resonator, perform a high quality because of excellent characteristics, the fabricating price can be reduced because of adaptation to a large scale production.

Figure 8:
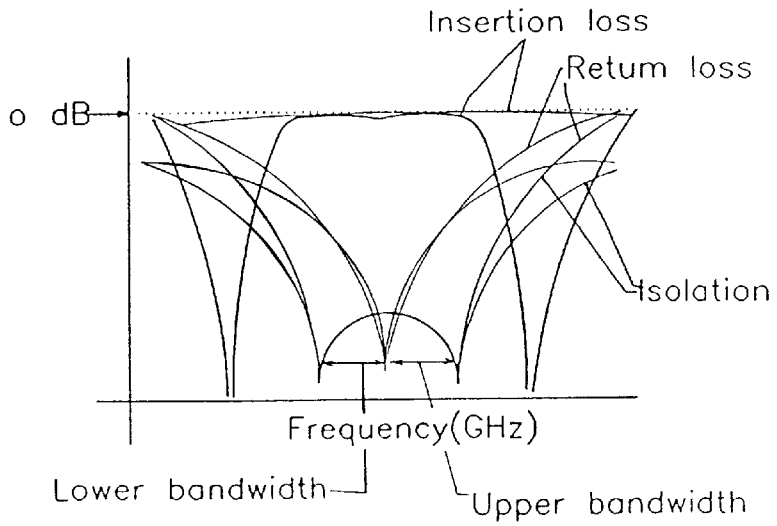
FIG. 8 is a bandwidth characteristic view of a microstrip/stripline isolator/circulator having a propeller resonator according to a preferable embodiment of the present invention.
Figure 9A:
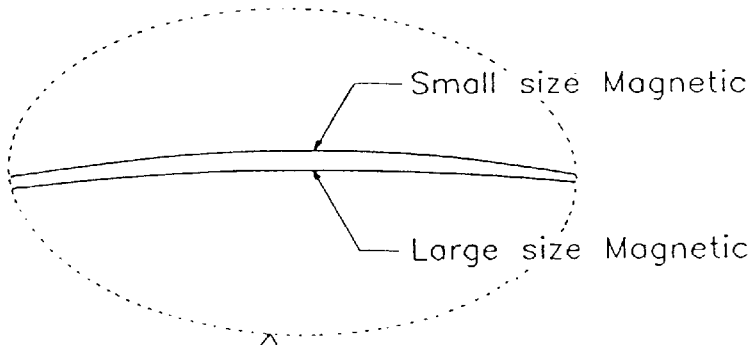
FIGS. 9*a* and 9*b* show an insertion loss view of a microstrip/stripline isolator/circulator having a propeller resonator according to a preferable embodiment of the present invention.
Figure 9B:
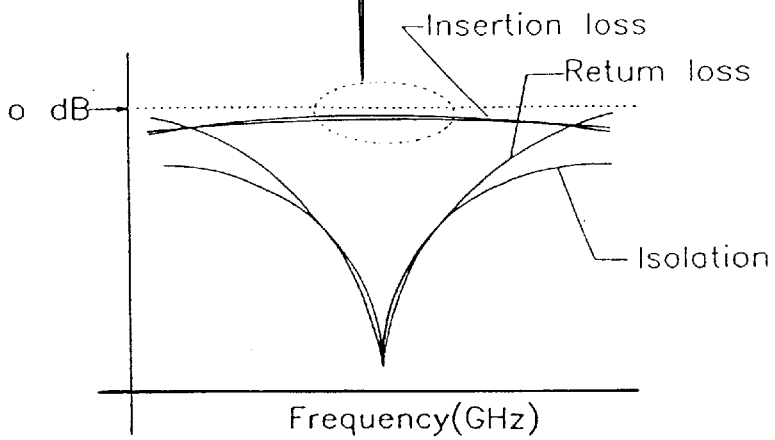
Figure 10A:
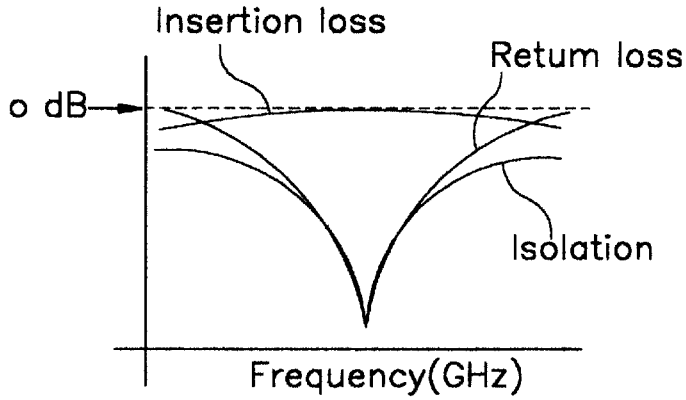
FIGS. 10*a*–10*c* are a frequency and pole point characteristic view of a microstrip/stripline isolator/circulator having a propeller resonator according to a preferable embodiment of the present invention.
Figure 10B:
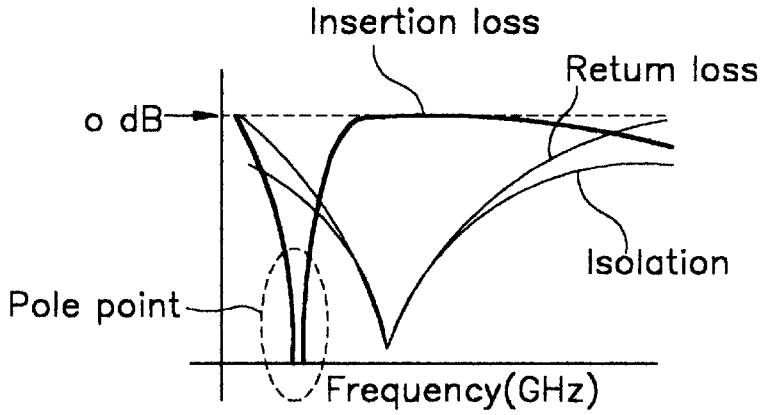
Figure 10C:
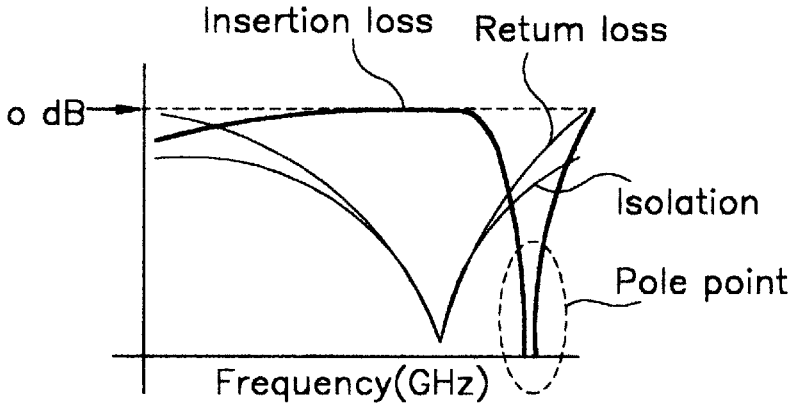

FIG. 8 is a bandwidth characteristic due to controlling the transmission line 406*a*, 406*b* connected to the 3-way asymmetric propeller resonator. FIG. 9 is an insertion loss characteristic due to controlling the magnet size 408 formed in the 3-way asymmetric propeller resonator. FIGS. 10*a*–10*c* are a frequency and pole point characteristic illustrated in the group of slots 407*a*, 407*b*, 407*c* for controlling the magnetic coupling at the edge of the 3-way asymmetric propeller resonator.

The isolator/circulator of the present invention as described above can constantly maintain a size of the 3-way asymmetric propeller resonator and intensity of magnetism, control the preferred frequency, and improve the insertion loss and isolation characteristic due to reducing the ferrite usage region on the maximum, extend the bandwidth without external bandwidth extension, finally to miniaturize, reduce the fabricating price by means of simple fabrication. The microstrip/stripline isolator/circulator having the propeller resonator according to the present invention can be used for the device protection and impedance matching of the system and terminal in a transfer communication, personal communication, CT and satellite communication.

As described above, although the present invention has been described in detail with reference to illustrative embodiments, the invention is not limited thereto and various modifications and changes may be effected by one skilled in the art within the scope of the invention.

What is claimed is:

1. A stripline isolator/circulator, comprising:

an upper ferrite substrate;

a lower ferrite substrate;

an upper grounded electrode being positioned on the upper ferrite substrate and having an upper permanent magnet inside and four screws penetrated therethrough;

a lower grounded electrode being positioned on the lower ferrite substrate and having a lower permanent magnet inside and said four screws penetrated therethrough;

an upper cover which shields the magnetic field;

SMA connectors which connect external circuits with striplines; and a load resistance connected to one of said SMA connectors;

wherein a stripline positioned between said upper ferrite substrate and lower ferrite substrate comprises:

first through third magnetic wall coupling controlling slots which form a 3-way asymmetric propeller resonator which controls a magnetic coupling of the verge of said resonator to control the frequency and which transfers a signal in a single direction in which said magnetic wall coupling controlling slots are provided, first through third bandwidth controlling transmission lines each of which control the bandwidth by use of a ratio of length of the transmission line, being formed in one side of the respective magnetic wall coupling controlling slots as one body, and first through a third terminal electrodes each of which connects one of said bandwidth controlling transmission lines with an external circuit to transmit the signal as one body.

2. The stripline isolator/circulator according to claim 1, wherein angles determining said magnetic wall coupling controlling slots which form a 3-way asymmetric propeller resonator are controlled freely to transmit the signal.

3. The stripline isolator/circulator according to claim 1, wherein said 3-way asymmetric propeller resonator is formed so that a ratio Ri/Ro of a radius Ri of said 3-way asymmetric propeller resonator inscribed and a radius Ro of 3-way asymmetric propeller resonator circumscribed is controlled to increase and decrease the frequency.

4. The stripline isolator/circulator according to claim 1, wherein said upper permanent magnets and lower permanent magnets are disposed in an area which is smaller than an area of said 3-way asymmetric propeller resonator.

5. The stripline isolator/circulator according to claim 4, wherein said 3-way asymmetric propeller resonator is formed having a radius for controlling a low insertion loss so that a size of said upper and lower permanent magnets is reduced due to reducing a usage region of said ferrite substrate.

6. The stripline isolator/circulator according to claim 1, wherein said 3-way asymmetric propeller resonator has a radius for controlling a low insertion loss so that a size of said upper and lower permanent magnets is reduced due to reducing a usage region of said ferrite substrate.

7. The stripline isolator/circulator according to claim 1, wherein said bandwidth controlling transmission lines, formed on the basis of a length of $\lambda/4$ at the central frequency, comprise:

first and second transmission lines which are extended and connected to one side of said each magnetic wall coupling controlling slot; and a third transmission line which controls a length ratio of said first and second transmission lines according to a position said first and second transmission lines are connected relative to a central portion of said resonator.

8. A microstripline isolator/circulator, comprising:

a ferrite substrate;

a thin dielectric on said ferrite substrate;

an upper grounded electrode having an upper permanent magnet inside and four screws penetrated therethrough;

a lower grounded electrode having a lower permanent magnet inside and four screws penetrated therethrough;

an upper cover which shields the magnetic field;

SMA connectors which connect external circuits with striplines; and a load resistance connected to one of said SMA connectors;

wherein a microstripline positioned between said ferrite substrate and thin dielectric comprises:

first through third magnetic wall coupling controlling slots which form a 3-way asymmetric propeller resonator which controls a magnetic coupling of the verge of said resonator for controlling the frequency and which has excellent signal transfer characteristics in a single direction in which said magnetic wall coupling controlling slots are provided, a 3-way asymmetric propeller resonator having excellent signal transfer characteristics in a single direction in which said magnetic wall coupling controlling slots are provided first through third wide band controlling transmission lines each of which controls the bandwidth use of a ratio of length of the transmission line, being formed in one side of the respective magnetic wall coupling controlling slots as one body, and first through third terminal electrodes each of which connects one of said bandwidth controlling transmission lines with an external circuit to transmit the signal as one body.

9. The microstripline isolator/circulator having a propeller resonator according to claim 8, wherein said upper/lower permanent magnets are composed of an area relatively smaller than an area of said 3-way asymmetric propeller resonator, have respectively any form.

* * * * *

UNITED STATES PATENT AND TRADEMARK OFFICE

CERTIFICATE OF CORRECTION

PATENT : 6,130,587

DATED : October 10, 1999

INVENTOR(S) : Dong Suk JUN, et al.

It is certified that error appears in the above-identified patent and that said Letters Patent is hereby corrected as shown below:

On title page, item 73 Assignee
replace "Electronics and Telecommunications Research Institute, Daejon, Rep. of Korea"
with --Electronics and Telecommunications Research Institute, Daejon, Rep. of Korea, and Korea Telecom Authority, Seoul, Rep. of Korea--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*